US005803416A

United States Patent [19]

Hanson et al.

[11] Patent Number: 5,803,416

[45] Date of Patent: Sep. 8, 1998

[54] HAND, WRIST AND/OR LOWER ARM SUPPORT PAD AND ASSEMBLIES

[75] Inventors: Alden B. Hanson, Boulder; David W. Claus, Longmont; Philip C. Corbett, Westminster, all of Colo.

[73] Assignee: Alden Laboratories, Inc., Boulder, Colo.

[21] Appl. No.: 912,796

[22] Filed: Aug. 18, 1997

Related U.S. Application Data

[63] Continuation of Ser. No. 418,017, Apr. 6, 1995, abandoned.

[51] Int. Cl.[6] ..... B43L 15/00

[52] U.S. Cl. ..... 248/118; 248/118.1; 248/918; 400/715

[58] Field of Search ..... 248/118, 118.1, 248/918; 400/715

[56] References Cited

U.S. PATENT DOCUMENTS

| | | | |
|---|---|---|---|
| 3,402,411 | 9/1968 | Hanson . | |
| 3,635,849 | 1/1972 | Hanson . | |
| 4,255,202 | 3/1981 | Swan, Jr. . | |
| 5,093,138 | 3/1992 | Drew et al. . | |
| 5,100,712 | 3/1992 | Drew et al. . | |
| 5,131,174 | 7/1992 | Drew et al. . | |
| 5,147,685 | 9/1992 | Hanson . | |
| 5,159,717 | 11/1992 | Drew et al. . | |
| 5,163,646 | 11/1992 | Engelhardt | 400/715 X |
| 5,204,154 | 4/1993 | Drew et al. . | |
| 5,356,099 | 10/1994 | Sereboff | 248/918 X |
| 5,435,508 | 7/1995 | Deuitch et al. | 248/118 |
| 5,445,349 | 8/1995 | Hart | 400/715 X |
| 5,476,491 | 12/1995 | Mayn | 248/118 X |
| 5,535,975 | 7/1996 | Scott | 248/118.1 X |

*Primary Examiner*—Ramon O. Ramirez
*Assistant Examiner*—Derek J. Berger
*Attorney, Agent, or Firm*—Harold A. Burdick

[57] ABSTRACT

A hand, wrist and/or lower arm support pad and related assemblies are disclosed for use by operators of typewriter or computer keyboards, ten key pads and/or various computer peripherals such as a trackball or computer mouse. The support pad includes an enclosure defining a containment area having a flowable material therein and structure to assure retention of the enclosure at a selected location. The retention structure may be integral to the enclosure and/or may be associated with related assemblies. The flowable material preferably exhibits fluid-like characteristics, and, more preferably, is characterized by a non-constant shear rate to shear stress ratio. In some embodiments, it is preferred that the material will not flow under its own weight (i.e., no, or substantially reduced, cold flow characteristics).

18 Claims, 5 Drawing Sheets

HAND, WRIST AND/OR LOWER ARM SUPPORT PAD AND ASSEMBLIES

This application is a continuation of application Ser. No. 08/418,017, filed Apr. 6, 1995, now abandoned.

FIELD OF THE INVENTION

This invention relates to pads and rests, and, more particularly, relates to support pads for hands, wrists, and/or lower arms used by an operator of a keyboard, ten key pad, computer mouse, trackball or the like.

BACKGROUND OF THE INVENTION

Operators of various keyboard and/or computer peripheral devices are known to experience discomfort and fatigue of the fingers, wrist and/or lower arm after extended periods of use of such devices. At the extreme, conditions such as various carpal tunnel irritations and repetitive motion disorders have been reported.

A variety of rests and pads have been devised in response to these occurrences. The most typical examples of such pads and rests are fabric covered foam articles. Such foam rests, however, have not proven altogether successful, since the foam typically exhibits only limited ability to conform to pressures exerted by the user on the pad. These articles thus may actually apply pressure to locations on the hand, wrist and/or lower arm during use, or induce unnatural or uncomfortable hand to forearm alignment.

Other examples of devices to alleviate the above-described conditions are known which include cradles movable on rollers or the like. These devices, however, are unduly complex, may be expensive to produce, and, in some cases, may limit the range of motion desired by the operator of a device such as a computer mouse. Further improvements to support pads of these types could thus still be utilized.

SUMMARY OF THE INVENTION

This invention provides an improved hand, wrist and/or lower arm support pad and related assemblies for use by operators of devices such as keyboards of various types and/or autolocating mechanisms employed in computer processing (for example, a trackball or a computer mouse). The pad not only provides greater comfort and improved, more neutral, positioning of the user's hands and wrists, but also provides conformable wrist, hand and/or lower arm location substantially without pressure points which may be felt by the user (thus providing a reduction of wrist, finger and/or forearm fatigue and soreness), as well as a tactile cue for proper hand location relative to the device.

The support pad includes an enclosure defining a containment area, the containment area having a flowable material therein. Position retention structure is associated with the enclosure to enable retention of the enclosure at a selected location relative to either the operator or the device.

Position retention structure could take a variety of forms, including an edge portion configured to nestle against a side of the device, a friction material such as hook and loop or non-slip plastic or rubber material, and/or retention trays or pad bases.

The enclosure preferably is configured with at least a first arcuate edge portion. In its embodiment for use with a computer mouse, the outer edge of the enclosure may be substantially circular.

The flowable material held in the containment area of the enclosure is preferably a pressure compensating material having fluid-like characteristics. More particularly, the material is preferably characterized by a non-constant shear rate to shear stress ratio, flowing more readily when higher shear stress is applied than when lower shear stress is applied. For some embodiments of the invention, the material has a viscosity selected to avoid cold flow of the material so that the material will not flow to its own weight.

The improved support pad of this invention for use by operators of a computer mouse provides more precise hand movement for finer mouse manipulations due to greatly reduced friction and the fluidic movement of the support pad.

It is therefore an object of this invention to provide an improved hand, wrist and/or lower arm support pad and assemblies for use by operators of manually manipulable devices maintained at a utilization area.

It is another object of this invention to provide an improved support pad for use by an operator of a keyboard, trackball, computer mouse or the like which secures greater comfort, better positioning, freer movement, and less fatigue of the hand, wrist and/or lower arm of the operator.

It is still another object of this invention to provide a hand, wrist or lower arm support pad for use by an operator of a manually manipulable device maintained at a utilization surface, the support pad including an enclosure defining a containment area, position retention structure associated with the enclosure to enable retention of the enclosure at a selected location relative to one of the operator and the device, and a flowable material in the containment area of the enclosure.

It is yet another object of this invention to provide a hand, wrist or lower arm support pad for use by an operator of a manually manipulable device maintained at a utilization surface, the support pad including an enclosure having upper and lower surface portions joined together at outer edges to define a containment area, the joined edges defining at least a first arcuate edge portion of the enclosure, and flowable pressure compensating material in the containment area of the enclosure, the material having fluid-like characteristics.

It is still another object of this invention to provide a hand, wrist or lower arm support pad for use by an operator of a computer mouse, the support pad including an enclosure defining a containment area and having an overall arcuate outer edge defining an interface between upper and lower surfaces of the enclosure, position retention structure associated with the enclosure to enable retention of the enclosure at a selected position relative to one of the operator and the computer mouse, and flowable material in the containment area of the enclosure.

It is yet another object of this invention to provide a hand, wrist or lower arm support pad for use by an operator of a manually manipulable device maintained at a utilization surface, the support pad including an enclosure defining a containment area with a flowable material therein, the flowable material being characterized by a non-constant shear rate to shear stress ratio.

It is yet another object of this invention to provide a hand, wrist or lower arm support pad for use by an operator of a manually manipulable device maintained at a utilization surface, the support pad including an enclosure defining a containment area with a flowable material therein, the flowable material being characterized by being resistant to cold flow.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
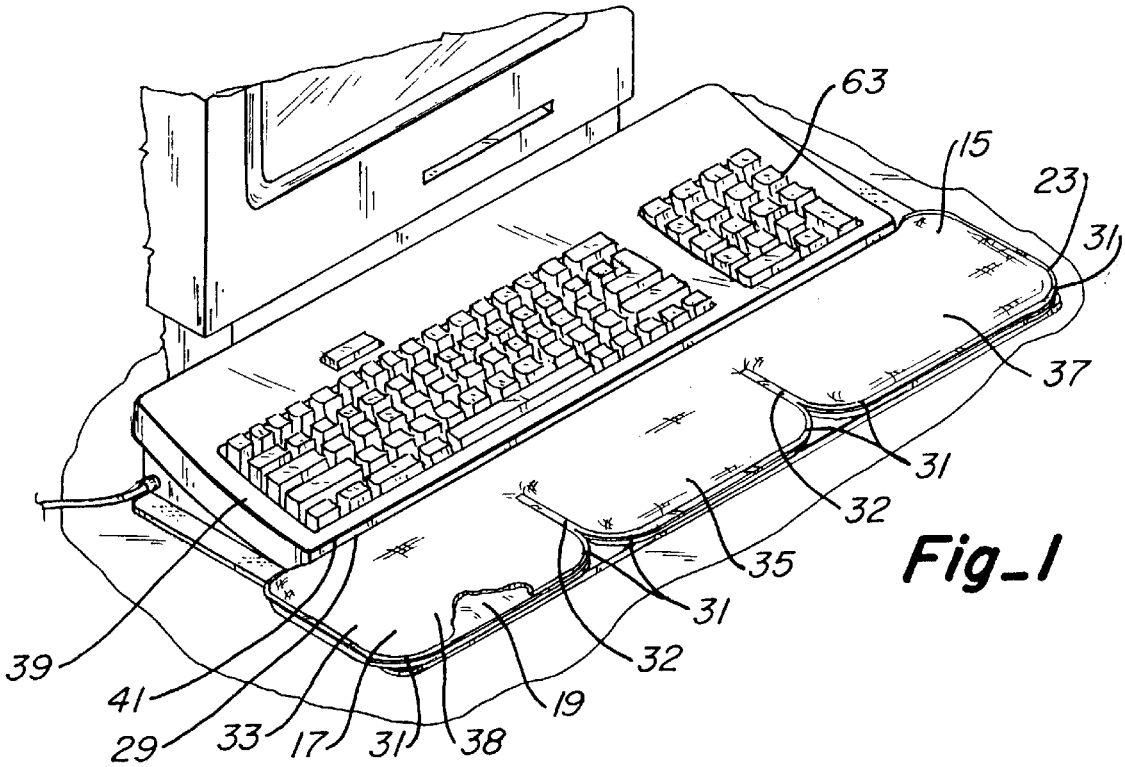
FIG. 1 is a perspective view of a first embodiment of a support pad assembly of this invention.
Figure 2:
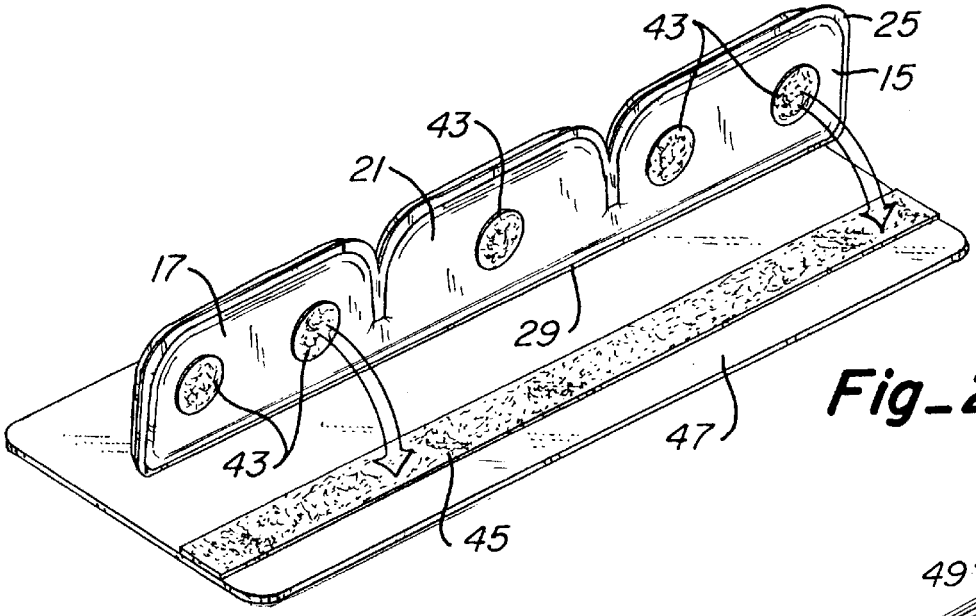
FIG. 2 is a perspective view of the support pad assembly of FIG. 1 with a pad of this invention raised from its base.
Figure 3:
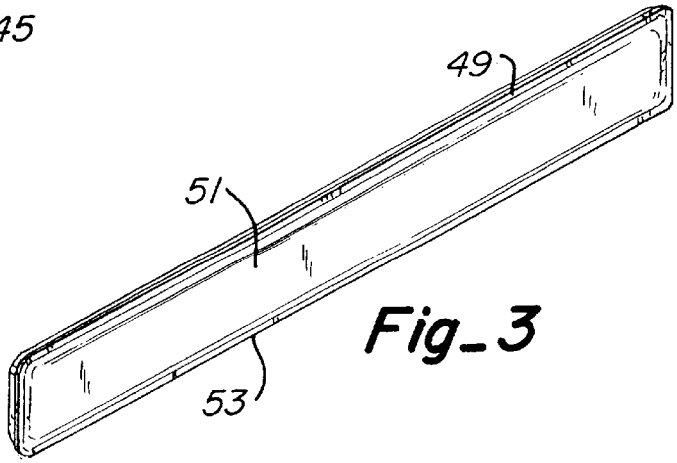
FIG. 3 is a perspective view of an alternative embodiment of the pad of this invention.
Figure 4:
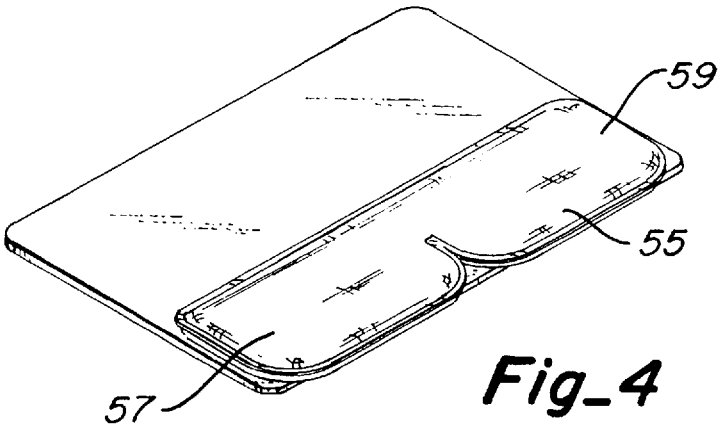
FIG. 4 is a perspective view of a second embodiment of support pad assembly of this invention.
Figure 5:
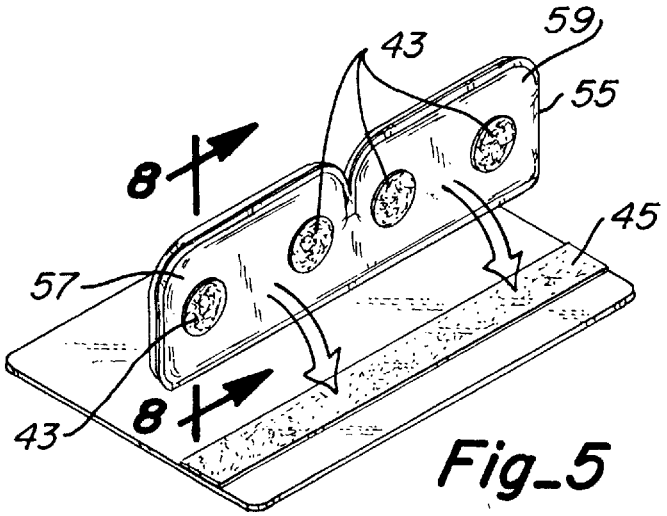
FIG. 5 is a perspective view of the support pad assembly of FIG. 4 with the pad raised from its base.

Various embodiments of the support pad and related assemblies of this invention are illustrated in the FIGURES. Illustrated in FIGS. 1 and 2 is a pad arrangement suitable for a full computer keyboard. In FIG. 3 another pad for computer and/or typewriter keyboards is shown. FIGS. 4 and 5 show a pad arrangement adapted for the alphanumeric portion of a computer keyboard or a typewriter, while in FIGS. 6 and 7 a pad arrangement adapted for ten key machines (or related keyboard section or a computer keyboard) or computer trackballs is illustrated. FIGS. 9 through 13 show a pad arrangement for a computer mouse (an autolocating peripheral used to locate a cursor on a computer monitor).

Figure 8:
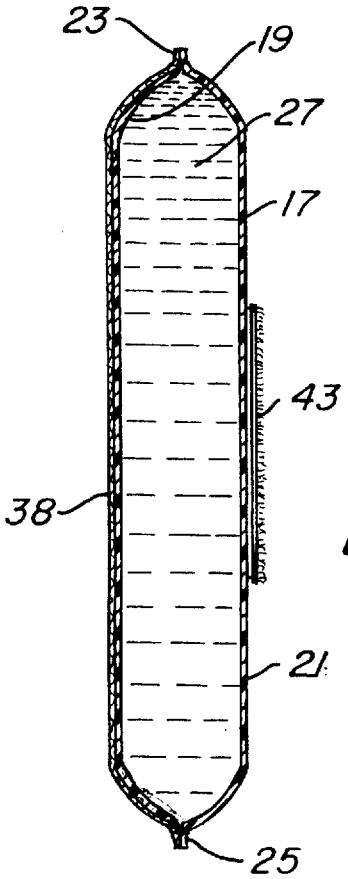
FIG. 8 is a sectional view taken along section lines 8—8 of FIG. 5 but which is illustrative of the pads illustrated in FIGS. 1 through 7.

Support pad 15 of FIGS. 1 and 2 includes enclosure 17 formed by upper and lower surface sheets 19 and 21 joined (by heat sealing or the like) at their outer edges 23 and 25 thus defining a containment area 27 (see FIG. 8). Sheets 19 and 21, and thus enclosure 17, include a straight edge portion 29 and a plurality of arcuate edge portions 31, some of which, together with closed seams 32, define segments 33, 35, and 37 of enclosure 17. Containment area 27 is filled with a conformable, pressure compensating flowable material (which will be discussed in greater detail hereinafter). Upper surface 19 may be covered by fabric 38 (for example stretch nylon Lycra or brushed nylon tricot) joined at outer edge 23 (by heat sealing or the like).

Provision of straight edge portion 29 assures (even without further securement) a degree of position retention of pad 15 relative to keyboard 39 when nestled against keyboard edge 41. The various arcuate corners 31 provide better flow and pad movement characteristics responsive to user applied pressures. Improved position retention of the support pad may be accomplished utilizing friction material 43, which may be any of separate attached pads of low- or non-slip material such as neoprene rubber or the like, hook and loop) material, such as Velcro pads (thus requiring mating pad or pads 45 on the utilization surface or, as shown, on a separate assembly base 47), spray on material applied directly to lower enclosure surface sheet 21, or lower surface sheet 21 itself made of a low- or non-slip material.

FIG. 3 illustrates a greatly simplified keyboard pad 49 without segments defined therein but otherwise of similar construction to that shown in FIG. 1. In such case, however, desired flow characteristics are provided in some cases by increasing the viscosity of flowable material held in the containment area of enclosure 51 of pad 49. Support pad 49 is primarily retained at a position adjacent to a keyboard by provision of straight edge 53 (for abutment against the keyboard), though any of the various other position retention techniques above-described could be utilized.

Where desired, for example for use with a typewriter or where space or other considerations might require, support pad 55 shown in FIGS. 4 and 5 can be utilized. Similar in construction to the pad shown in FIG. 1, support pad 55 includes only two segments 57 and 59 similar in size to or smaller than segments 33 and 35 of support pad 15. Multiple pads 55 may be used in combination to span an entire computer keyboard. Again the various position retention techniques heretofore set forth apply.

Figure 6:
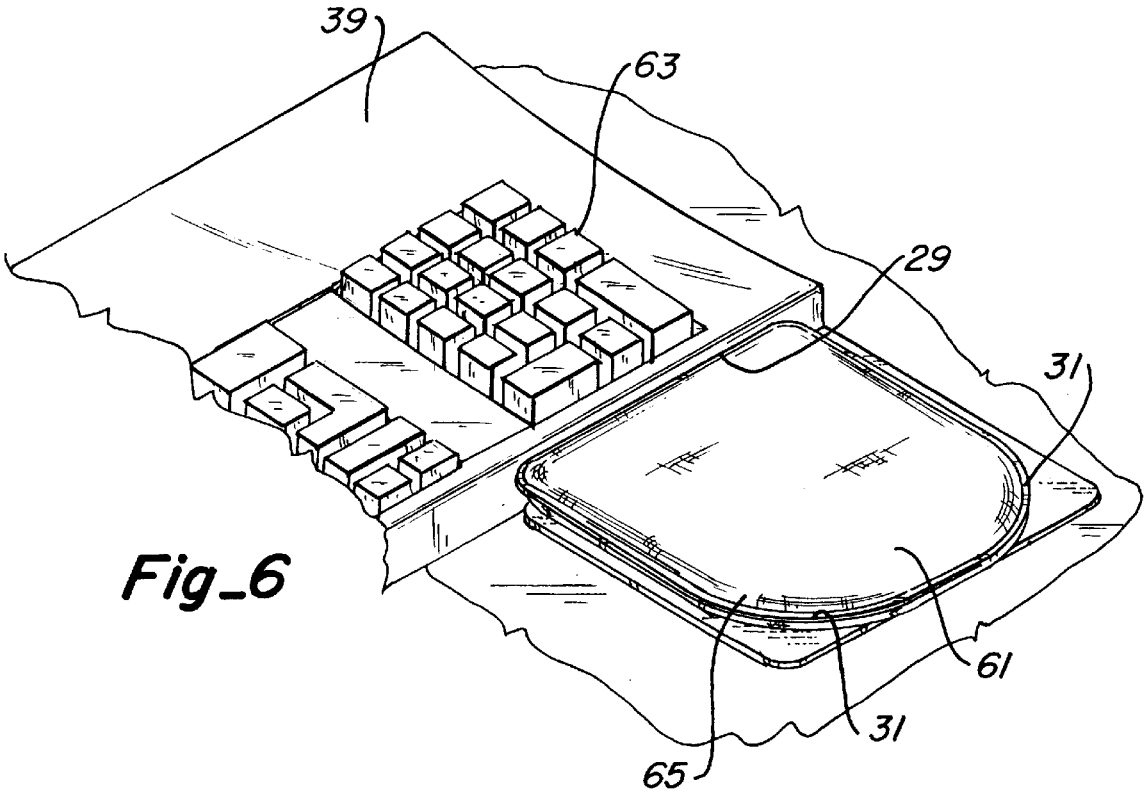
FIG. 6 is a perspective view of a third embodiment of a support pad assembly of this invention.
Figure 7:
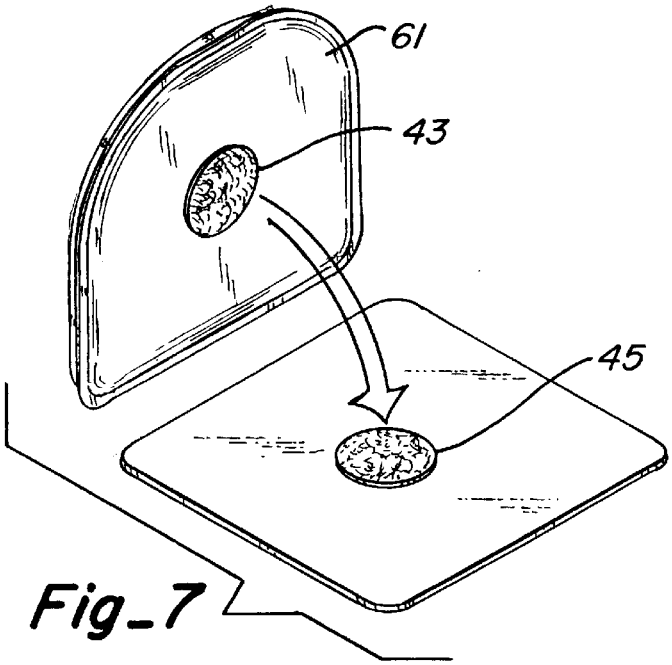
FIG. 7 is a perspective view of the support pad of FIG. 6 with the pad raised from its base.

Support pad 61 shown in FIGS. 6 and 7 is adapted for use with smaller keyboards (ten key machines, calculators or the like), keyboard segments (such as numeric key section 63 of computer keyboard 39), a trackball, or in side-by-side arrangement with other pads 61 to span any keyboard length, but is otherwise similar in construction and operation to the support pads of this invention previously described herein. However, support pad 61 is formed of a single enclosure segment 65 similar in size to or smaller than segment 37 of support pad 15. Support pad 61 in some cases may be used in combination with support pad 55 or with other ones of pad 61 (the arrangement of multiple pads 61 along a keyboard may in fact be the best mode yet devised for achieving the advantages of this invention as applied to computer or typewriter keyboards).

FIG. 8 is a sectional illustration (taken from FIG. 5, it being understood that the illustration represents a section of any of the support pads 15, 49, 55 or 61) showing containment of the flowable material within enclosure 17 of the support pads of this invention. As illustrated, sheets 19 and 21 are joined to form an envelope of selected thickness, the amount and viscosity of flowable material, and volume, size and seam 32 placement and length (where present) of enclosure 17 being selected to provide desired flow characteristics, pad movement, pressure responsiveness and pad rebound (or, in the alternative, pad memory).

Figure 9:
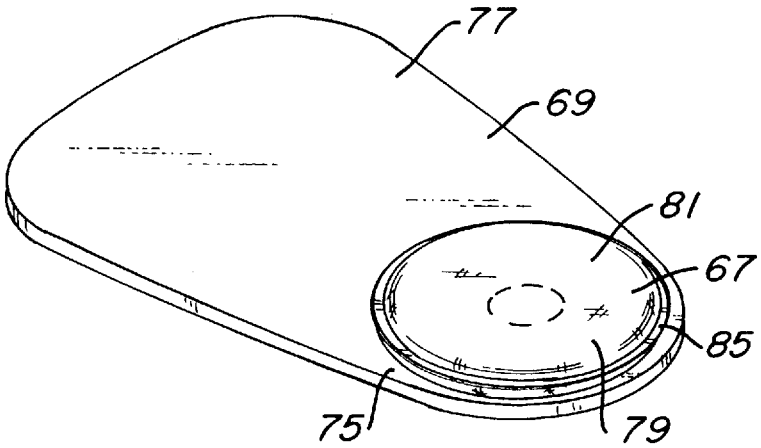
FIG. 9 is a perspective view of a fourth embodiment of a support pad assembly of this invention.
Figure 10:
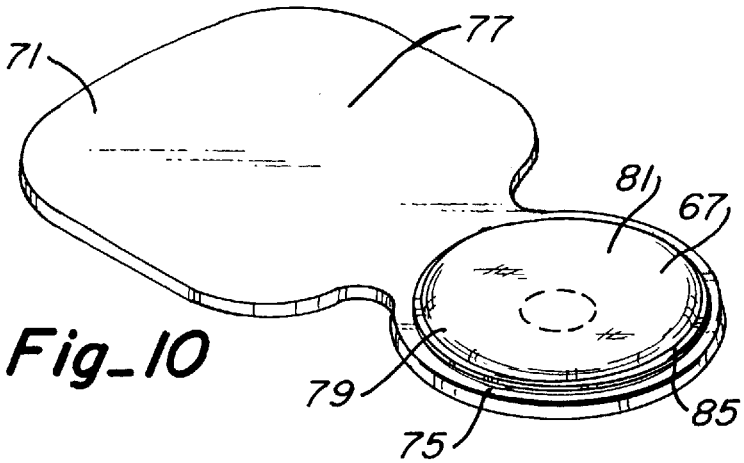
FIG. 10 is a perspective view of the pad of FIG. 9 on a different base.
Figure 11:
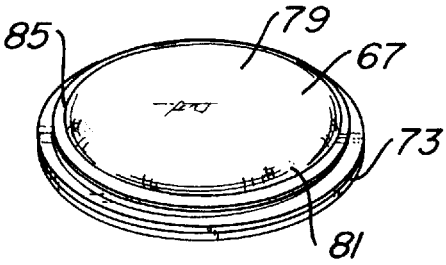
FIG. 11 is a perspective view of the pad of FIG. 9 on yet another base.

FIGS. 9 through 14 illustrate an embodiment of the support pad and related assemblies of this invention for utilization by operators of a computer mouse. Support pad 67 is shown in FIGS. 9, 10 and 11 with differently configured bases 69, 71 and 73, respectively. Bases 69 and 71 include pad positioning area 75 and operating surface 77 for mouse manipulation thereat. Base 73 includes only positioning area 75, mouse manipulation occurring on any adjacent surface.

Alternatively, position retention techniques requiring no related base or matable attachment, as heretofore discussed (i.e., integrated or separate low- or non-slip materials, spray on materials, and the like), could be utilized with mouse manipulation occurring on the adjacent surface. Moreover, support pad 67 could be applied directly to the wrist of a user (by straps, matable Velcro attachments at the pad and wrist, or the like), position retention relative to the utilization surface in such case being relatively less important.

Support pad 67 includes enclosure 79 formed by substantially circular upper and lower surface sheets 81 and 83, respectively. Sheets 81 and 83 are joined (by heat sealing, for example) at outer edge 85 thus defining containment area 87 having a conformable, pressure compensating flowable material sealed therein. Fabric cover 88 over upper surface sheet 81 is joined at outer edge 85 as heretofore disclosed.

Figure 12:
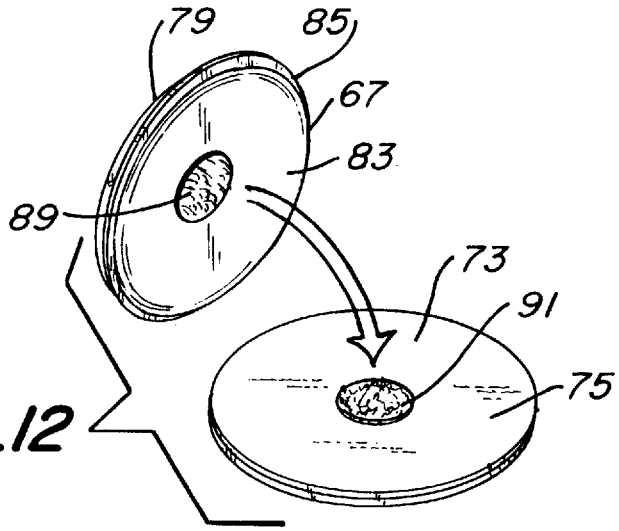
FIG. 12 is a perspective view of the support pad assembly of FIG. 11 with the pad raised from its base.
Figure 13:
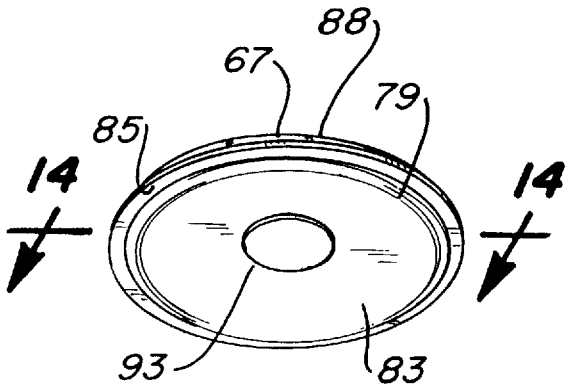
FIG. 13 is a perspective view of the pad of FIG. 9 but utilizing a different position retaining structure thereon.
Figure 14:
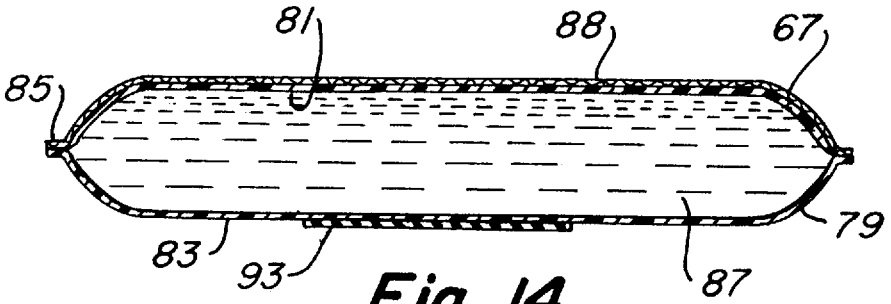
FIG. 14 is a sectional view taken through section lines 14—14 of FIG. 13 but which is illustrative of the pads of FIGS. 9 through 13.

As shown in FIG. 12, position retention may be secured by velcro pad 89 centrally affixed (for example, by gluing or the like) to lower surface sheet 83 and matable with Velcro pad 91 at base 73. As shown in FIG. 13, for a free standing pad (i.e., one utilizing no separate base in a pad assembly), a neoprene rubber or other non-slip material 93 may be centrally affixed to sheet 83.

By utilizing position retention materials only at the center of the lower sheet of the pad, preferably where the exposed lower sheet surface area not having retention materials applied thereat exceeds the surface area where retention materials are applied thereat, for example as shown in FIGS. 2, 5, 7, 8, 12, 13 and 14, a type of sliding parallelogram movement is achieved. That is to say, starting with the user's wrist centered at rest on, for example, support pad 67, the pad will accommodate movement of the wrist away from the original center with increasing resistance the further the movement of the wrist from the original center. Friction between the appendage being supported and the top surface of the support pad allows lateral movement to cause the upper surface sheet of the pad to move, thereby deforming the leading edge of the pad (in the lateral direction of the force) and pulling the trailing edge of the pad up. When lateral forces applied by the user are relaxed, the weight of the wrist (i.e., downward force) causes the pad to return to its original position and shape with the wrist centered on the pad.

Thus, pad 67 tends to behave as a self centering support, movement of the entire arm or forearm being used to manipulate the mouse instead of articulation of the wrist in a horizontal plane. Pad 67, utilizing the conformable, flowable material therein, allows the user's wrist to be supported in a neutral, natural position without regard to the position of the user's arm relative to the utilization surface over which the mouse is manipulated.

Upper and lower surface sheets of the various embodiments of the invention herein set forth may be made of various materials including any flexible light weight, preferably pliable material having a certain degree of elasticity and resistance to puncturing. Materials having a thickness of between about 0.1 and 0.8 millimeters, depending on the material are typical. Polyurethane, polyvinyl, acetal, acrylic, cellulosic, chlorinated polyether, flourocarbon (TFE, CTEE, or FEP), nylon (polyamide), polycarbonate, polyetheylene, polystyrene, polyester, and polysulfone materials could all be utilized (preferably 0.2 millimeter polyurethane). If desired, convexivity may be introduced into the upper and lower surface sheets, for example by vacuum forming (see U.S. Pat. No. 5,159,717, the contents of which are incorporated hereinto by this reference).

Bases 47, 69, 71 and 73 may be made of any desired material, including rigid plastics materials (particularly useful for known bases of the type used under keyboards such as base 47) or more cushioned bases made of foamed plastic or rubber material such as polyethylene, ethafoam, EVA or neoprene foam rubber (particularly useful as bases 69, 71 or 73).

Regarding the method of constructing the various embodiments of the present invention, after cutting into the desired shape, upper and lower surface sheets are affixed to each other at their outer edges, for example by heat sealing or other methods known to those skilled in the art. The seal between the sheets is a substantially flat surface. A small opening is left in the enclosure seal for insertion of a filling apparatus into the thus formed enclosure. The filling apparatus is inserted into the opening and a predetermined volume of the flowable material is placed into the enclosure of the support pad. The filling apparatus is then removed and the opening in the enclosure is sealed. Cover fabrics are then cut and secured as heretofore discussed (alternatively, they may be applied in a single heat sealing step when the upper and lower sheets are affixed and the opening sealed). It is to be realized, that the cutting of the material into the final shape of the pads may occur at any time during the process.

While it is typically unnecessary to remove air from the enclosure prior to sealing (because air will also act as a shock absorbing medium, and, in fact, could be utilized as the sole flowable material in the enclosure), air removal can be performed if desired (i.e., where a pad having no "bounce" is required) prior to sealing of the opening so that only flowable material will occupy the containment area of the enclosure.

Shape and size of the enclosure are application specific. The size of the enclosure, or enclosure segment, is typically slightly larger (approximately 10%) than the surface area of the portion of the appendage being supported. The shape of the upper and lower surface sheets (and thus the enclosure) determines the range of lateral movement of the pad which occurs pursuant to user applied forces. A circular enclosure allows equal range of movement in all lateral directions. An oval shaped enclosure would allow the range of motion to be modified so there is less range of motion in the direction of the longer axis of the oval (primarily due to greater required deformation of the longer edges of the enclosure). A square shaped enclosure would allow a greater range of motion in directions perpendicular to the sides (though non-simultaneously). A rectangularly shaped enclosure would allow a greater range of motion in the shorter axis than in the longer axis.

The volume of fluid contained in the enclosure of the support pads of this invention would typically be about 25% to 75% of the maximum volume capacity of the enclosure (achievable without significant deformation of the enclosure material). As the fill volume approaches the upper part of this range, stability of the pad decreases. In other words, the force required to laterally move the pad decreases. However, increased viscosity of the material tends to increase stability of the pad because of the greater applied forces required to cause pad movement. The variation of fill volume to fill material viscosity is thus utilizable to achieve a variety of pad characteristics. Other variables utilized to vary pad characteristics include higher durometer and thicker upper and lower surface sheet materials, and size and type of position retention material utilized.

Pad 15 preferably measures about 4.25 inches by 19.375 inches, with a thickness of about 0.812 inches when filled. The various segments 33, 35 and 37 are each of about equal size. Seams 32 extend into the pad about 2.75 inches (leaving an unobstructed passage between the end of the seams and straight edge 29 of about 1.5 inches).

Pad 49 preferably measures about 3 inches by 19.375 inches, with a thickness of about 0.625 inches when filled. Support pad 55 preferably has a length of about 12.625 inches (other measurements being about the same as set forth above for pad 15), with segments 57 and 59 being of about equal size. Pad 61 preferably measures about 4.75 inches square with two adjacent corners having about a 0.5 inch radius and the opposite two adjacent corners having about a 2 inch radius. Pad 61 has a thickness of about 0.7 inches (preferably about 0.72 inches) when filled. Pad 67 preferably has a diameter of about 4.5 inches and a thickness of about 0.625 inches when filled.

Where a non-slip retention pad (for example of neoprene rubber) such as pad 93 in FIG. 13 is to be utilized for position retention of support pads 61 or 67, the material is preferably about 3 inches in diameter and about one-eighth to one-sixteenth of an inch thick. The retention pad is attached substantially at the center of the lower surface sheet of the support pad (by gluing or the like). Where hook and loop material is to be utilized, three-quarter inch to 3 inch hook and loop material pads may be utilized.

The flowable material utilized to occupy the containment area of the enclosures of the various embodiments of the invention herein disclosed may be any flowable material which reacts to an applied force by migrating to other regions of the support pad to more effectively distribute forces over a larger area of the pad. Thus the material must exhibit fluid-like characteristics. Materials such as wax, glycerin, water, salt water, grease, fats, oils, propylene glycol, syrup and even air or some particle materials either alone or in mixture with a fluid material may thus be used. Other appropriate flowable materials are HB Fuller 1454 Hot Melt (a flowable microcrystalline wax) and glycerine and the various materials produced by Alden Laboratories, Inc. under the trademark (either of which are preferred for their nontoxicity). The preferred materials are compositions including wax, oil and glass micro-spheres. For more detailed disclosure of some such materials that may be appropriate for use with this invention see U.S. Pat. Nos. 5,204,154, 5,100,712, 5,093,138, 4,255,202 and 3,635,849, the contents of which are incorporated hereinto by this reference.

The preferred materials for use with this invention, such as the above-mentioned materials, are flowable while not having total memory. In other words once deformed, the material will not always return to its original shape (thus providing a tactile cue for the user when returning to use of a keyboard having such a support pad adjacent thereto). However, some materials appropriate for use in this invention do exhibit a degree of gel strength, the gel structure being broken merely by applying a small but sufficient force to the pad, and these materials are preferred for support pads of this invention in many keyboard application.

Many of the above mentioned materials, and the flowable material preferably utilized in this invention, behave in an non-Newtonian manner, because their viscosities change when the shear rate changes. In other words, the ratio of shear rate (flow) to shear stress (force) is not constant. These materials are typically either pseudoplastic or thixotropic. A pseudoplastic material is one which appears to have a yield stress beyond which flow commences and increases sharply with an increase in stress. In practice, the materials exhibit flow at all shear stresses although the ratio of flow to force increases negligibly until the force exceeds the apparent yield stress. The flow rate of a thixotropic material increases with increasing duration of agitation as well as with increased shear stress. In other words, the flow rate is time dependent. When agitation is stopped, internal shear stress can exhibit hysteresis. Upon re-agitation, less force is generally required to create a given flow than is required for the first agitation. The fact that the materials preferably used in this invention flow more readily when higher shear stress is applied is advantageous.

The flowable materials used in the present invention have a viscosity in a range of between about 50 and 250,000 centipoise, and are selected to provide good pressure distribution throughout the entire area of the hand, wrist and/or lower arm in contact with the pad. For example, the preferred viscosity of the flowable material used in support pads 15, 49, 55 and 61 is between about 10,000 and 250,000 centipoise. For applications where no or reduced cold flow (i.e. the tendency to flow to its own weight) is desired, for example to achieve a pad having memory, and thus providing a tactile cue, of hand, wrist or lower arm placement, the viscosity of the material should be in the 150,000 to 250,000 centipoise range (for example Alden Laboratories Inc. formula no. 2005).

Mouse support pad 67, preferably allowing a greater degree of pad movement and responsiveness to user arm movement, would require a less viscous material (between about 50 and 100,000 centipoise, and preferably between about 5,000 and 10,000 centipoise). Alden Laboratories Inc. formula no. 3020 has been found to be a material having a viscosity achieving the desired characteristics.

As discussed hereinabove, the amount of fill and the volume of the pad also affect the range of parallelogram type pad motion achieved. For a round pad 67, 25% to 75% of the volume of the enclosure could be filled for useful embodiments of this invention. For example, a pad 67 having a diameter of about 4.5 inches and a volume of about 12 cubic inches, about 6.8 cubic inches of material is preferably placed into the containment area of enclosure 79.

As may be appreciated, this invention provides an improved hand, wrist and/or lower arm support pad and related assemblies for use by an operator of a device such as a keyboard, trackball or computer mouse, the pad providing for greater comfort, improved positioning of the user's hands and wrists, conformable wrist, hand and/or lower arm location substantially without pressure points, and a tactile cue for proper hand relocation relative to the device. The improved support pad of this invention for use by operators of a computer mouse provides more precise hand movement for finer mouse manipulations due to greatly reduced friction and the fluidic movement and resistance of the support pad.

What is claimed is:

1. A hand, wrist or lower arm support pad for use by an operator of a manually manipulable device maintained at a utilization surface, said support pad comprising:

an enclosure formed by first and second flat flexible material sheets each having an outer edge defined thereby and extending therearound, said first and second sheets joined to one another at said outer edges thereof thus defining a containment area;

position retention structure applied to a portion of said first material sheet to enable retention of said enclosure at a selected location relative to one of the operator and the device, said portion of said first material sheet having an exposed surface area less than half that of said first material sheet of said enclosure; and a flowable pressure compensating composition exhibiting a non-constant shear rate to shear stress ratio in said containment area of said enclosure.

2. The support pad of claim 1 wherein said position retention structure includes a non-slip material.

3. The support pad of claim 1 wherein said position retention structure includes a friction material configured for normally contacting the utilization surface, and wherein said enclosure includes at least a first supporting segment no more than about five inches across said segment in any direction between said edges.

4. The support pad of claim 3 wherein said friction material includes a first engageable material.

5. The support pad of claim 4 wherein said position retention structure further comprises a base having a second engageable material positioned thereat to engage said first material.

6. The support pad of claim 1 wherein said joined outer edges of said first and second sheets of said enclosure is continuously arcuate.

7. The support pad of claim 1 wherein said enclosure includes a plurality of segments each having arcuate outer edge portions.

8. The support pad of claim 1 wherein said position retention structure is centrally located at said first sheet.

9. A hand, wrist or lower arm support pad for use by an operator of a manually manipulable device maintained at a utilization surface, said support pad comprising:

an enclosure having an upper surface portion formed of a single, flat flexible sheet of material having an outer edge defined thereby and extending therearound continuously arcuately along at least a substantial part thereof, and said enclosure having a lower surface portion formed of a single, flat flexible sheet of material having an outer edge defined thereby and extending therearound continuously arcuately along at least a substantial part thereof, said outer edges of said sheets of material forming said upper and lower surface portions joined together so that a containment area is defined between said upper and lower surface portions; and flowable pressure compensating material in said containment area of said enclosure, said material having fluid-like characteristics.

10. The support pad of claim 9 wherein said flowable pressure compensating material is characterized by a by a non-constant shear rate to shear stress ratio.

11. The support pad of claim 10 wherein said flowable pressure compensating material has a viscosity in a range of between about 50 and 250,000 centipoise.

12. The support pad of claim 9 wherein said flowable pressure compensating material is a mixture of liquid and particles, said mixture flowing more readily when higher shear stress is applied than when lower shear stress is applied.

13. The support pad of claim 9 further comprising a layer of fabric over said upper surface portion of said enclosure.

14. The support pad of claim 9 wherein said flowable material is characterized by resistance to cold flow of the material.

15. A hand, wrist or lower arm support pad for use by an operator of a computer mouse, said support pad comprising:

an enclosure defining a containment area and having an overall arcuate outer edge extending continuously therearound and defined by direct interface of an upper surface with a lower surface of said enclosure;

position retention structure applied to a central portion of said lower surface of said enclosure to enable retention of said enclosure at a selected position relative to one of the operator and the computer mouse, said portion of said lower surface having an exposed surface area less than half that of said lower surface of said enclosure; and flowable material in said containment area of said enclosure.

16. The support pad of claim 15 wherein said enclosure surfaces are substantially circular.

17. The support pad of claim 15 further comprising a base having an area for positioning of said enclosure and a surface for operation of the computer mouse.

18. The support pad of claim 15 wherein said flowable material has fluid-like characteristics and is characterized by a non-constant shear rate to shear stress ratio.

* * * * *